United States Patent [19]

Munson

[11] 4,237,671

[45] Dec. 9, 1980

[54] INSULATION BARRIER FOR RECESSED LIGHT FIXTURES

[75] Inventor: Richard W. Munson, Minnetonka, Minn.

[73] Assignee: Insulation Sales Company, Minneapolis, Minn.

[21] Appl. No.: 927,341

[22] Filed: Jul. 24, 1978

[51] Int. Cl.[3] ..... E04F 19/00

[52] U.S. Cl. ..... 52/584; 52/28

[58] Field of Search ..... 52/28, 576, 577, 699, 52/700, 701, 221, 584; 46/31; 24/73 PC

[56] References Cited

U.S. PATENT DOCUMENTS

| | | | |
|---|---|---|---|
| 2,148,892 | 2/1939 | Bales | 24/73 PC |
| 2,388,297 | 11/1945 | Slaughter | 46/31 X |
| 2,607,972 | 8/1952 | Rust | 24/73 PC |
| 3,224,205 | 12/1965 | Greiner et al. | 52/537 X |
| 3,512,318 | 7/1968 | Turner | 52/699 X |

*Primary Examiner*—James A. Leppink
*Assistant Examiner*—Carl D. Friedman
*Attorney, Agent, or Firm*—Dorsey, Windhorst, Hannaford, Whitney & Halladay

[57] ABSTRACT

A dam assembly for preventing the build up of thermal insulation around a recessed lighting fixture in the attic space of a building which includes a plurality of fire-proof, pre-cut panels which may be joined together at the site by clips so as to surround the portion of the fixture extending into the attic space and allow free circulation of air thereabouts so that excessive heat build up is avoided. The dimensions of the pre-cut panels are such that joist spacings of 16 and 24 inch on centers can be accommodated.

6 Claims, 4 Drawing Figures

INSULATION BARRIER FOR RECESSED LIGHT FIXTURES

BACKGROUND OF THE INVENTION

I. Field of the Invention

This invention relates generally to safety apparatus for preventing fires caused by the entrapment of heat from recessed ceiling light fixtures, and more specifically to a kit which may be utilized by construction or insulation contractors for maintaining a safe spacing of thermal insulation from the recessed light fixture such that heat dissipating air circulation about the fixture can be maintained.

II. Description of the Prior Art

In residential and commercial building structures it is common practice to insulate the ceiling by blowing cellulose material into the attic space so that it covers the ceiling of the living space to a predetermined thickness. Alternatively, fiberglass bats are installed between the ceiling joists to inhibit the flow of heat from the living space through the ceiling to the attic space. It is also common practice to utilize recessed lighting fixtures in the living space which include a portion which extends through the ceiling into the attic space. If the thermal insulation blanket is permitted to encroach upon the recessed light fixture, there is the potential for heat entrapment and excessive heat build up within the recessed lighting fixture which could result in damage to the wiring or to the surrounding combustible materials used in the building construction.

Because of the potential for fire, Paragraph 410–66 of the National Electric Code 1978 provides:

"Clearance for flush and recessed fixtures—Recessed portions of enclosures, other than at points of support, shall be spaced at least ½" from combustible material. Thermal insulation shall not be installed within 3" of the recessed fixture enclosure, wiring compartment or ballast, and shall not be so installed above the fixture so as to entrap heat and prevent the free circulation of air unless the fixture is otherwise approved for the purpose."

In order to comply with this code requirement, builders have used a number of expedients, none of which offers the versitility of the present invention. For example, during construction of the building, it is common practice to build a wooden teepee-type structure over the fixture with two sides thereof being open. While this arrangement is generally suitable for use when insulation bats are employed, it does not solve the problem when blown-in insulation is utilized. When loose cellulose type blown insulation is employed, it too can build up within the teepee structure and blanket the recessed light fixture. Then too, the time which it takes to fabricate the structure at the site out of plywood and install it over the recessed light fixture is quite time consuming and therefore costly.

I am also aware of a product sold under the trademark INSUL-CAN by the Insul Can Company of Oklahoma City, Okla. which is designed to solve the problem of maintaining a minimum safe clearance between the thermal insulation and a recessed light fixture in the attic space of a building. This product comprises a trapezoidal container fabricated from sheet metal and which has an open bottom so that it may be placed over the extension of the light fixture which is in the attic space. However, it is found that this device does not meet the aforementioned National Electric Code in that it does not prevent the free circulation of air about the fixture and merely serves to enlarge the volume of air whose temperature is increased by the presence of the recessed light fixture therein.

SUMMARY OF THE INVENTION

In accordance with the teachings of the present invention, I provide, in kit form, an assembly which serves to maintain a minimum safe clearance between the thermal insulation used in a building construction and the extension of recessed light fixtures which project into the attic space. The present invention meets all of the applicable fire codes and is less costly to use than on-site constructed prior art arrangements. In its simplest form, the present invention comprises a plurality of panels which may be fabricated from a fire-proof material such as Portland cement reinforced with asbestos fibers. These panels are pre-cut to predetermined length and width dimensions so they can be made to readily accommodate differing joist spacing in the building construction. Also included in the kit are a plurality of clips which permit the panels to be joined, one to the other, so as to completely surround on all vertical sides the portion of the recessed light fixture extending into the attic space. When so assembled, the structure is open at its top to permit the free circulation of air around the recessed light.

OBJECTS

It is accordingly the principal object of the present invention to provide an improved means for maintaining a minimum safe distance between thermal insulation used in the attic space of a building and the portion of a recessed light fixture extending into the attic space.

Another object of the invention is to provide, in kit form, a device of the type described which is easy to assemble at the site.

Still another object of the invention is to provide an insulation dam which is in full compliance with existing building codes.

These and other objects and advantages of the invention will become apparent to those skilled in the art from the following detailed description of the preferred embodiment when taken in conjunction with the accompanying drawings in which like numerals in the several views refer to corresponding parts.

DESCRIPTION OF THE PREFERRED EMBODIMENT

Figure 1:
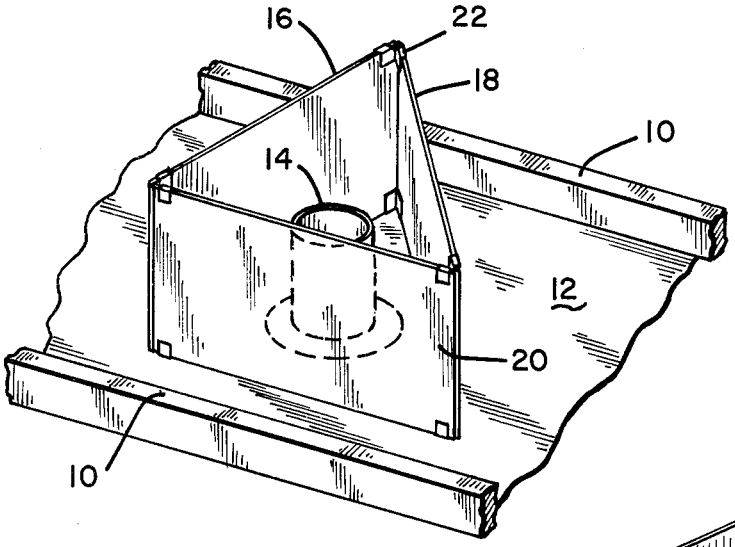
FIG. 1 is a perspective view of the insulation dam wherein three panel members are employed.

Referring first to FIG. 1, there is indicated by numeral 10 a pair of spaced apart ceiling joists to which is attached a ceiling panel 12 of sheet rock or other suitable material. Numeral 14 identifies a recessed ceiling light fixture having a portion thereof extending upward into the attic space of the building. It is normal in such building construction to insulate the upper surface of the ceiling panel 12 with either fiberglass insulation bats or with loose blown cellulose insulating material. As was indicated in the introductory portion of this specification, building electrical codes dictate that this thermal insulation must be maintained a predetermined distance from the recessed fixture 14 in order to permit the escape of heat energy generated by the incandescent lamp utilized in the recessed light fixture. In order to maintain this minimum safe spacing, in accordance with the teachings of the present invention I provide a plurality of panels such as panels 16, 18 and 20 which are preferably formed from a fire-proof material having good dimensional stability. It has been found that asbestos-cement sheets sold under the trademark PANELSTONE by the GAF Corporation are readily suited for the present application, however, other materials may also be used. The PANELSTONE sheets are composed of a special formulation of Portland cement reinforced with asbestos fiber and, as such, are noncombustible, will not permit flame spread and produce no toxic smoke under elevated temperatures.

Each of the panels 16, 18 and 20 is generally rectangular and of uniform dimension. It has been found that panels having a length of 16 inches and a width of 12 inches is most practical in that it permits use with ceiling structures whose joist spacing is either 16 inches on center or 24 inches on center.

Figure 4:
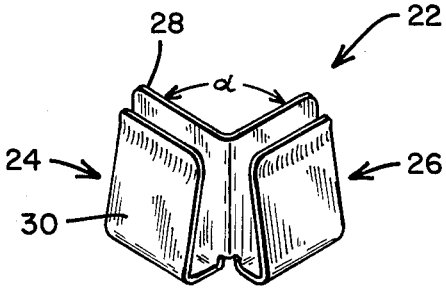
FIG. 4 is a drawing illustrating the design of the clip members used to join the individual panels, one to the other.

In order to secure the panels together, one to the other, there is provided a plurality of clips, the configuration of which can best be seen with reference to the drawing of FIG. 4. The clip is indicated generally by numeral 22 and includes a pair of integrally joined U-shaped segments 24 and 26. Each such segment includes first and second legs 28 and 30 which are joined together at the bottom and spaced apart by a distance corresponding generally to the thickness of the panels with which they are to be used. The clips may be formed from a suitable metal or plastic and are bent so as to form a predetermined angle, $\alpha$, between the legs 28. The angle $\alpha$ may be in the range of 60° to 90° so that either three panels may be employed to form a generally triangular enclosure or four panels may be employed to form an enclosure. The clip 22 may be fitted over the top or bottom edges of adjacent panels so as to maintain same in a vertical orientation and spacing.

Figure 2:
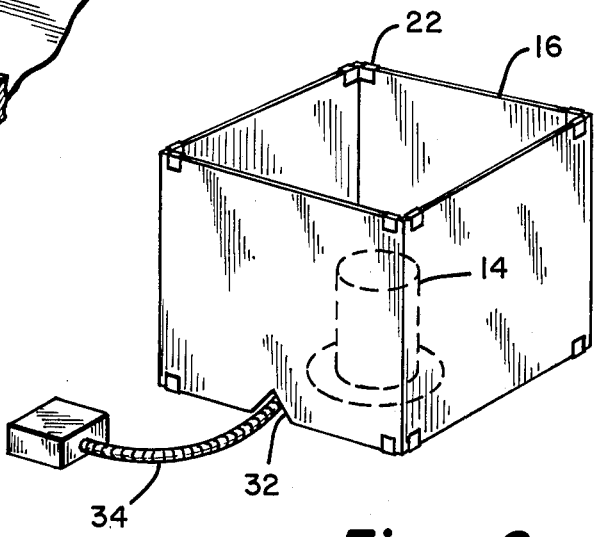
FIG. 2 is a perspective drawing of the preferred embodiment of an insulation dam utilizing four panels.

With reference to FIG. 2, there is shown by means of an isometric view the manner in which four precut panels may be assembled to define a rectangular enclosure about the portion of a recessed light fixture which extends into the attic space. Using this arrangement, it is possible to maintain the specified 3 inch spacing between the recessed light fixture and the thermal insulation used in the attic space. Again, by using fire-proof panels of a 12 inch × 16 inch dimension, one can maintain the 3 inch spacing around fixtures varying in diameter from 3 inches to 10 inches. Because the assembly is opened at its top, free air circulation around the recessed light fixture is permitted. The panels can readily be snapped together on the job by employing the clips of the type depicted by FIG. 4. As can be further observed by FIG. 4, it is possible to field modify the dam or enclosure by scoring and notching as at 32 to allow entry of the cable 34 containing the wiring for the fixture.

Figure 3:
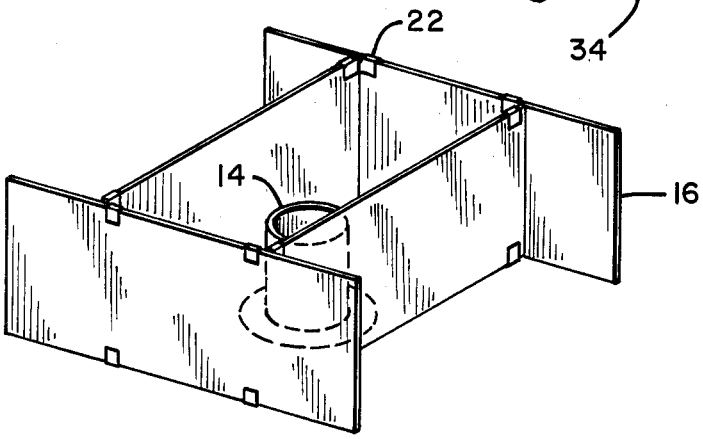
FIG. 3 is a perspective view showing an alternative interconnection of the panel members.

As can further be observed from FIG. 3, the use of the clips of FIG. 4 permits a high degree of flexibility in the positioning of the panels with respect to the fixture. Specifically, it is not essential that the mating panels be joined at their vertical edges, but as is illustrated by FIG. 3, opposed side panels can have their vertical edges located inwardly from the vertical edges of the opposed pair of side panels. As such, the design of the clip permits the side panels to be adjustable so that the minimum 3 inch code clearance can be maintained.

Through the use of the pre-cut, fire-proof panels of differing width and height dimensions additional flexibility is achieved in that one has a choice of depositing insulation to two different depths depending upon the relative orientation of the panels themselves. More specifically, with a panel having a 12 inch × 16 inch dimension, one can choose to deposit insulation to either a 12 inch depth or a 16 inch depth depending upon which dimension is used as the height dimension of the completed dam.

The invention has been described herein in considerable detail, in order to comply with the Patent Statutes and to provide those skilled in the art with information needed to apply the novel principles, and to construct and use the specialized components as are required. However, it is to be understood that the invention can be carried out by specifically different configurations of panels and clips, and that various modifications, both as to equipment details and operating procedures can be effected without departing from the scope of the invention itself.

What is claimed is:

1. Apparatus for maintaining a safe spacing between thermal insulation and a recessed light fixture having a portion extending into an insulated attic space comprising:

(a) first, second, third and fourth panel members each having exposed top and bottom edges and a pair of side edges and a predetermined length, width and thickness dimension and formed of a fire-proof material, said panel members being positioned proximate one another along the side edge of at least one of each pair of adjacent panels to form an enclosure surrounding the portion of a light fixture extending into an insulated attic space; and (b) a plurality of clips each comprising first and second U-shaped segments and each having opposed pairs of legs spaced apart a distance corresponding generally to the thickness of said panel members, each leg having a pair of side edges and a joined edge at which said leg is joined to its opposed leg, said first and second U-shaped members being joined together along a side edge of one of the legs of each U-shaped member such that the planes of said one legs are at a predetermined angle with respect to one another, said angle being substantially 90 degrees.

2. Apparatus as in claim 1 wherein said panels have a length and width dimension of 12 inches and 16 inches respectively.

3. Apparatus as in claim 1 wherein said clip members maintain said panel members in a 4-sided, open-ended boxlike configuration.

4. Apparatus for maintaining a safe space between thermal insulation and recessed light fixture in an insulated attic space comprising:

(a) a recessed light fixture having a portion extending into an attic space;

(b) at least three panel members having exposed top and bottom edges and a pair of side edges and a predetermined length, width and thickness dimension formed of a fire-proof material, said panel members being positioned proximate one another along the side edge of at least one of each pair of adjacent panels to form an enclosure surrounding the portion of said light fixture extending into said attic space; and (c) a plurality of preformed clips positioned to engage adjacent panels along the exposed top and bottom edges thereof to hold said panels in a desired orientation.

5. Apparatus of claim 4 wherein said panel members comprise a mixture of Portland cement reinforced with asbestos fibers formed into sheets of uniform thickness.

6. Apparatus for maintaining a safe spacing between thermal insulation and a recessed light fixture having a portion extending into an insulated attic space comprising:

(a) first, second and third panel members each having exposed top and bottom edges and a pair of side edges and a predetermined length, width and thickness dimension and formed of a fire-proof material, said panel members being positioned proximate one another along the side edge of at least one of each pair of adjacent panels to form an enclosure surrounding the portion of a light fixture extending into an insulated attic space; and (b) a plurality of clips each comprising first and second U-shaped segments and each having opposed pairs of legs spaced apart a distance corresponding generally to the thickness of said panel members, each leg having a pair of side edges and a joined edge at which said leg is joined to its opposed leg, said first and second U-shaped members being joined together along a side edge of one of the legs of each U-shaped member such that the planes of said one legs are at a predetermined angle with respect to one another, said angle being substantially 60 degrees.

* * * * *